US005386915A

United States Patent [19]

Sirhan

[11] Patent Number: 5,386,915

[45] Date of Patent: Feb. 7, 1995

[54] AIR TOOL RACK

[76] Inventor: Eddie Sirhan, 2410 Olympic Dr., So. San Francisco, Calif. 94080

[21] Appl. No.: 147,076

[22] Filed: Nov. 3, 1993

[51] Int. Cl.[6] ..... A47F 7/00

[52] U.S. Cl. ..... 211/70.6; 211/13

[58] Field of Search ..... 211/70.6, 88, 69, 70.1, 211/13

[56] References Cited

U.S. PATENT DOCUMENTS

| | | | |
|---|---|---|---|
| 1,357,123 | 10/1920 | Smith | 211/70.6 |
| 1,438,900 | 12/1922 | Chase | 211/69 X |
| 2,805,777 | 9/1957 | Larson | 211/70.6 X |
| 2,974,804 | 3/1961 | Maro | 211/70.6 |
| 3,542,209 | 11/1970 | Thompson | 211/70.6 |
| 4,830,198 | 5/1989 | Colquitt | 211/70.6 |

*Primary Examiner*—Alvin C. Chin-Shue
*Assistant Examiner*—Sarah L. Purol
*Attorney, Agent, or Firm*—McCubbrey, Bartels & Ward

[57] ABSTRACT

The present invention is a tool rack for storing air powered tools. The rack immobilizes each air powered tool by using a male air hose connector attached to the air powered tool. The male air hose connector has a flanged end and a neck region. The neck region has a diameter less than that of the flange region. The tool rack includes a first surface having a plurality of capture regions therein. Each tool capture region includes first and second regions. The first region has an opening sufficient to allow the passage of the flange region therethrough. The second region includes a slot having an opening less than the diameter of the flanged region but greater than the diameter of the neck region. The tool rack is attached to a surface such as the side of a tool box or tool tray-cart or to a wall via appropriate connectors. In the preferred embodiment of the present invention, the tool rack also includes a surface having clips attached thereto for immobilizing one or more sockets for use in conjunction with the air powered tools.

2 Claims, 3 Drawing Sheets

AIR TOOL RACK

FIELD OF THE INVENTION

The present invention relates to tool organizers, and more particularly, to an improved system for storing air powered tools.

BACKGROUND OF THE INVENTION

Compressed air powered tools such as impact wrenches, grinders, and the like have become increasingly popular. These devices provide higher torques and are more economical than similar electrically powered devices. As a result, a well equipped shop may have several air powered tools and numerous sockets or other accessories used by the tools.

The storage of such tools presents a problem. The tools vary widely in shape and size. Hence, any storage system must accommodate a wide variety of sizes. Ideally, the storage system would present the various tools to the user in a convenient arrangement that would allow the user to select the tool and accessories needed for any given job. In addition, the storage system should be capable of being attached to conventional tool boxes or tool trays,—carts that are rolled from place to place in the work area.

Broadly, it is the object of the present invention to provide an improved tool rack for housing air powered tools.

It is a further object of the present invention to provide a tool rack that can accommodate a variety of air tools having widely differing shapes.

It is a still further object of the present invention to provide a tool rack which may also be used to store sockets and other accessories commonly utilized in conjunction with air powered tools.

These and other objects of the present invention will become apparent to those skilled in the art from the following detailed description of the invention and the accompanying drawings.

SUMMARY OF THE INVENTION

The present invention is a tool rack for storing air powered tools. The rack immobilizes each air powered tool by using a male air hose connector attached to the air powered tool. The male air hose connector has a flanged end and a neck region. The neck region has a diameter less than that of the flange region. The tool rack includes a first surface having a plurality of capture regions therein. Each tool capture region includes first and second regions. The first region has an opening sufficient to allow the passage of the flange region therethrough. The second region includes a slot having an opening less than the diameter of the flanged region but greater than the diameter of the neck region. The tool rack is attached to a surface such as the side of a tool box or to a wall via appropriate connectors. In the preferred embodiment of the present invention, the tool rack also includes a surface having clips attached thereto for immobilizing one or more sockets for use in conjunction with the air powered tools.

DETAILED DESCRIPTION OF THE INVENTION

Figure 1:
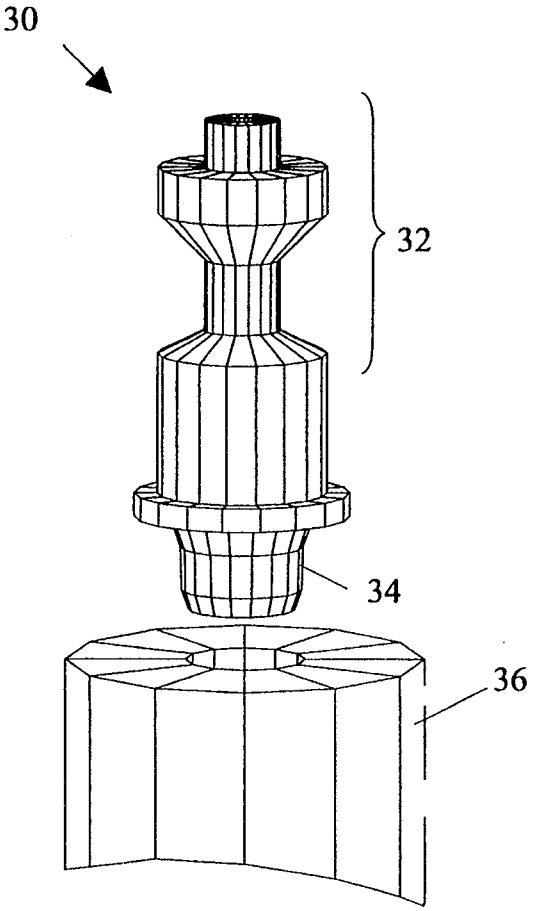
FIG. 1 illustrates the air hose fitting commonly used with air powered tools.

The present invention is based on the observation that almost all air powered tools utilize the same connector system for connecting the air powered tool to an air line. Referring to FIG. 1, each air powered tool 36 typically provides a threaded opening for connecting the tool to the air line. Since the tools are often changed, the connection to the air line is normally accomplished with the aid of a fast disconnect. The disconnect typically consists of a male connector 30 that is connected to the air powered tool 36 via threaded end 34 and a female connector that is attached to the air hose. The male connector includes a flanged end 32. The flange is engaged by the female connector. The size of the male connector is determined by the size of the air hose, not the size of the air tool. Since most shops have only one size of air hose; hence, all of the air tools will typically have the same male connector.

Figure 2:
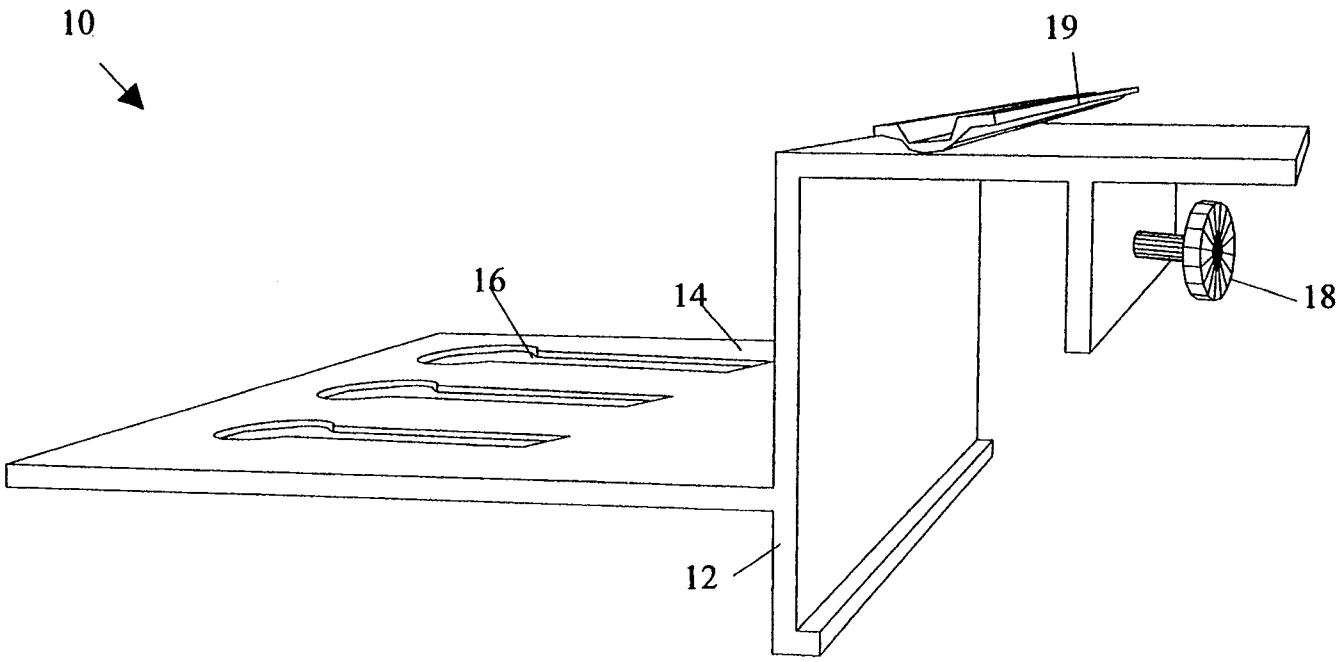
FIG. 2 is a perspective view of a tool rack according to the present invention.
Figure 3:
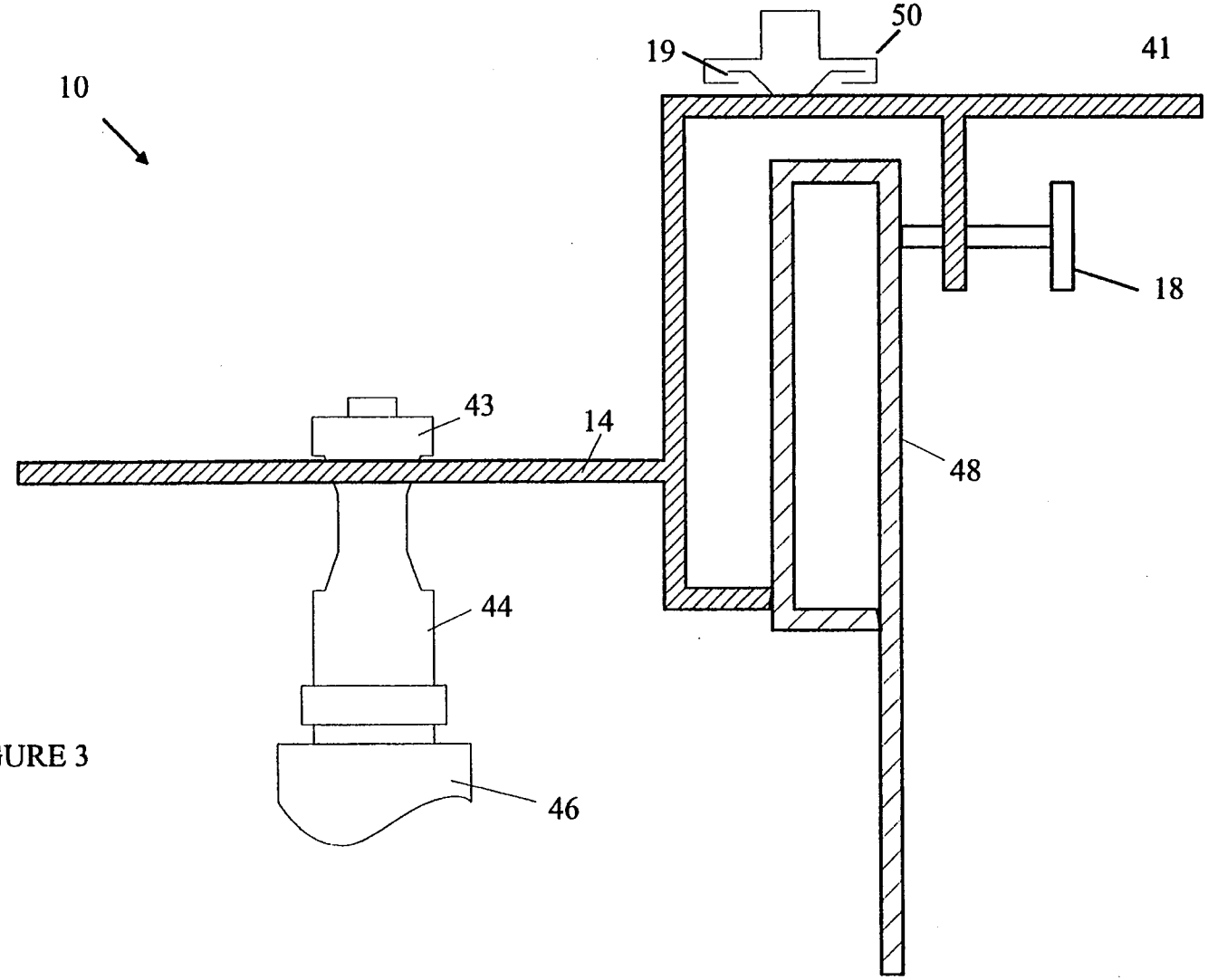
FIGS. 3 is an end view of a tool rack according to the present invention.

Refer now to FIGS. 2 and 3 which are a perspective and end view, respectively, of a tool rack 10 according to the present invention. Tool rack 10 is preferably constructed from an extrusion 12 having a long flat surface 14 which includes a plurality of toll capture regions 16. One end of each capture region 16 is of sufficient diameter to clear the flanged end 43 of a male air hose connector 44 when it is connected to air tool 46. The remainder of capture region 16 is a slot which is larger than the neck of the flanged region of the male connector but smaller than flanged end 43.

Tool rack 10 may be attached to the edge of a conventional tool box 48 by a thumb screw 18 which secures tool rack 10 to the tool box or tool tray-cart. Tool rack 10 may also be attached to a wall or other surface if portability is not required. It will be apparent to those skilled in the art that other types of fastening arrangements are possible.

Tool rack 10 also includes a storage system for accessories such as the sockets used with many air tools. The accessory storage system preferably comprises a second extrusion 19 which is mounted on a second surface 41 of tool rack 10. Extrusion 19 accepts clips 50 which are used to store the various sockets. In general, the sockets all have the same size hole in one end. This hole engages the drive shaft of the air tools. Each clip 50 immobilizes one socket by engaging the hole in question.

Various modifications to the present invention will become apparent to those skilled in the art from the foregoing description and accompanying drawings. Accordingly, the present invention is to be limited solely by the scope of the following claims.

What is claimed is:

1. A tool rack for storing air powered tools, each air powered tool including a male air hose connector having a flanged end, said flange comprising a neck region and a flange region, said neck region having a diameter less than that of said flange region, said tool rack comprising:

a first surface having a plurality of capture regions therein, each tool capture region including first and second regions, said first region having an opening sufficient to allow the passage of said flange region therethrough and said second region comprising a slot having an opening less than the diameter of said flanged region but greater than the diameter of said neck region;

means for connecting said surface to a wall; and clip means for storing a socket used by at least one of said air powered tool.

2. A tool rack for storing air powered tools, each air powered tool including a male air hose connector having a flanged end, said flange comprising a neck region and a flange region, said neck region having a diameter less than that of said flange region, said tool rack comprising:

a first surface having a plurality of capture regions therein, each tool capture region including a region comprising a slot having an opening less than the diameter of said flanged region but greater than the diameter of said neck region;

means for connecting said surface to a wall: and clip means for storing a socket used by at least one of said air powered tool.

* * * * *